US010964472B2

(12) United States Patent
Yang et al.

(10) Patent No.: US 10,964,472 B2
(45) Date of Patent: Mar. 30, 2021

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byeong Cheol Moon, Suwon-si (KR); Byung Soo Kang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 314 days.

(21) Appl. No.: 16/163,049

(22) Filed: Oct. 17, 2018

(65) Prior Publication Data

US 2019/0362887 A1 Nov. 28, 2019

(30) Foreign Application Priority Data

May 28, 2018 (KR) ..... 10-2018-0060267

(51) Int. Cl.

| | |
|---|---|
| ***H01F 27/28*** | (2006.01) |
| ***H01F 27/36*** | (2006.01) |
| ***H01F 27/29*** | (2006.01) |
| ***H01F 27/26*** | (2006.01) |

(52) U.S. Cl.

CPC ..... *H01F 27/36* (2013.01); *H01F 27/263* (2013.01); *H01F 27/2804* (2013.01); *H01F 27/292* (2013.01); *H01F 27/363* (2020.08); *H01F 27/366* (2020.08)

(58) Field of Classification Search

CPC ..... H01F 27/36; H01F 27/263; H01F 27/292; H01F 27/2804; H01F 27/366; H01F 27/363; H01F 2017/048; H01F 17/0013; H01F 17/04; H01F 27/2885; H01F 27/323; H01F 27/346; H01F 27/022; H01F 2017/002

See application file for complete search history.

(56) References Cited

U.S. PATENT DOCUMENTS

| | | | | |
|---|---|---|---|---|
| 6,115,264 | A * | 9/2000 | Nosaka | H01F 17/0013 333/172 |
| 6,154,112 | A * | 11/2000 | Aoba | H01F 27/292 336/185 |
| 9,126,491 | B2 * | 9/2015 | Ichikawa | B60L 53/38 |
| 2004/0017280 | A1 * | 1/2004 | Yamamoto | H01F 27/255 336/234 |
| 2010/0182116 | A1 * | 7/2010 | Ishimoto | H01F 17/0006 336/192 |
| 2012/0274432 | A1 * | 11/2012 | Jeong | H01F 17/0033 336/192 |
| 2016/0142033 | A1 | 5/2016 | Chong et al. | |

(Continued)

FOREIGN PATENT DOCUMENTS

| | | |
|---|---|---|
| JP | 2005-310863 A | 11/2005 |
| JP | 2017-076796 A | 4/2017 |

(Continued)

*Primary Examiner* — Mang Tin Bik Lian

(74) *Attorney, Agent, or Firm* — Morgan, Lewis & Bockius LLP

(57) ABSTRACT

A coil component capable of reducing leakage magnetic flux includes a body, a coil portion embedded therein, a shielding layer formed on a surface of the body, and a ground electrode electrically connected to the shielding layer on the surface of the body and grounding the shielding layer.

19 Claims, 6 Drawing Sheets

(56) References Cited

U.S. PATENT DOCUMENTS

| | | | | |
|---|---|---|---|---|
| 2016/0268038 | A1* | 9/2016 | Choi | H01F 17/0013 |
| 2017/0110240 | A1* | 4/2017 | Masuda | H01F 27/34 |
| 2017/0200682 | A1* | 7/2017 | Lin | H01L 24/97 |
| 2018/0096783 | A1* | 4/2018 | Fukuda | H01F 17/04 |
| 2018/0166211 | A1* | 6/2018 | Takatsuji | H01F 17/04 |

FOREIGN PATENT DOCUMENTS

| | | | |
|---|---|---|---|
| KR | 10-2016-0057645 | A | 5/2016 |
| KR | 10-2017-0085881 | A | 7/2017 |

* cited by examiner

COIL COMPONENT

CROSS-REFERENCE TO RELATED APPLICATION(S)

This application claims the benefit of priority to Korean Patent Application No. 10-2018-0060267 filed on May 28, 2018 in the Korean Intellectual Property Office, the disclosure of which is incorporated herein by reference in its entirety.

TECHNICAL FIELD

The present disclosure relates to a coil component.

BACKGROUND

An inductor, a coil electronic component, is a representative passive electronic component used in an electronic device, together with a resistor and a capacitor.

As electronic devices are gradually increased in performance and miniaturized, the number of electronic components used in the electronic devices has increased and electronic components have been miniaturized.

For this reason, demand for removing noise source such as electromagnetic interference (EMI) of the electronic components is gradually increased.

According to a current general EMI shielding technology, the electronic components are mounted on a substrate and the electronic components and the substrate are then simultaneously surrounded by a shield can.

SUMMARY

An aspect of the present disclosure may provide a coil component capable of reducing leakage magnetic flux.

An aspect of the present disclosure may provide a coil component capable of substantially maintaining component characteristics while reducing leakage magnetic flux.

According to an aspect of the present disclosure, a coil component may include a shielding layer formed on a surface of the body and a ground electrode connected to the shielding layer on the surface of the body and grounding the shielding layer.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
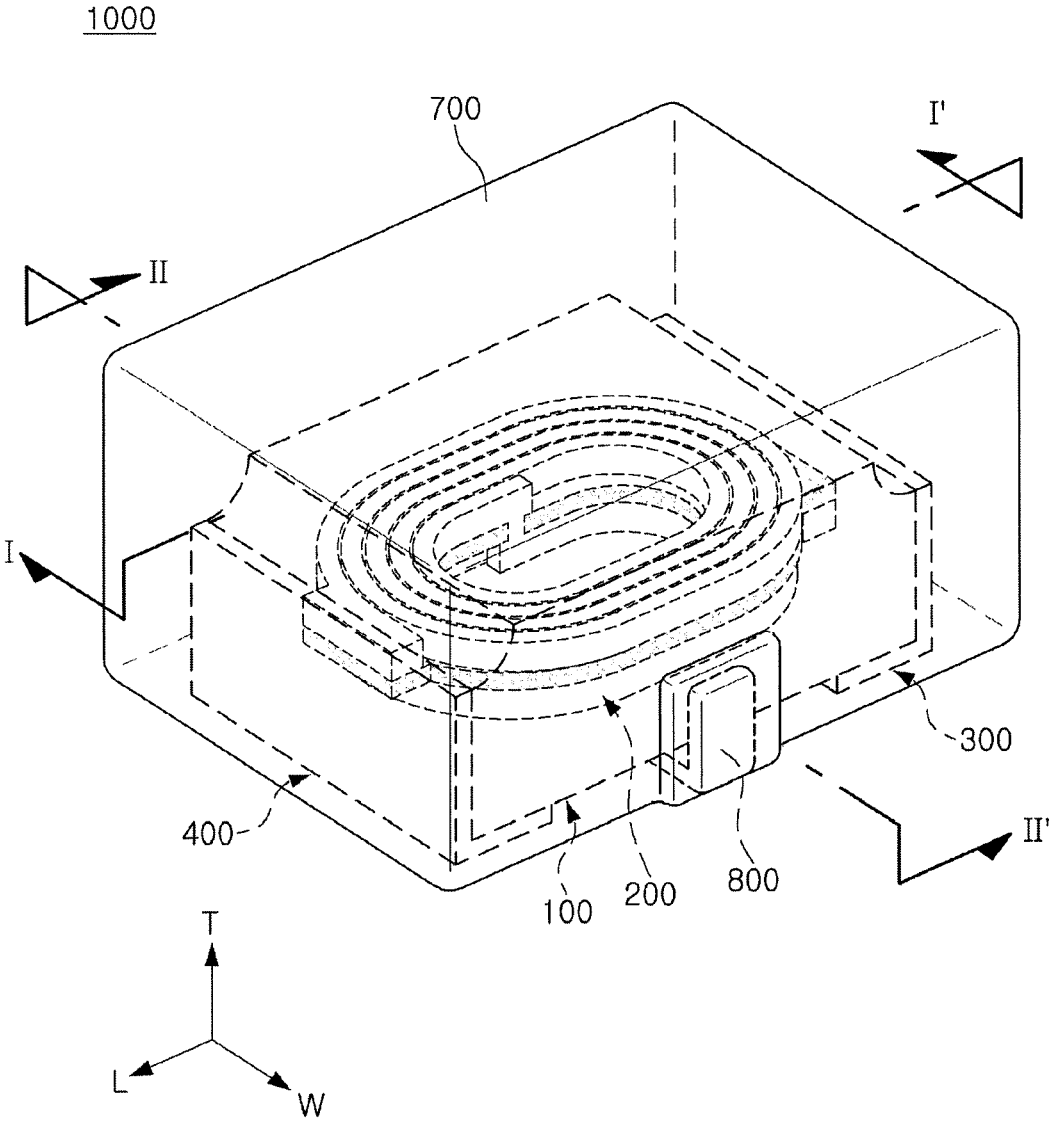
FIG. 1 is a perspective view schematically illustrating a coil component according to a first exemplary embodiment in the present disclosure.

Hereinafter, exemplary embodiments of the present disclosure will now be described in detail with reference to the accompanying drawings.

In the drawings, an L direction refers to a first direction or a length direction, a W direction refers to a second direction or a width direction, and a T direction refers to a third direction or a thickness direction.

Hereinafter, a coil component according to an exemplary embodiment in the present disclosure will be described in detail with reference to the accompanying drawings. In describing an exemplary embodiment in the present disclosure with reference to the accompanying drawings, components that are the same as or correspond to each other will be denoted by the same reference numerals, and an overlapped description thereof will be omitted.

Various types of electronic components may be used in electronic devices. Various types of coil components may be appropriately used for the purpose of noise removal or the like between such electronic components.

That is, a coil component in the electronic device may be used as a power inductor, a high frequency (HF) inductor, a general bead, a high frequency (GHz) bead, a common mode filter, or the like.

First Exemplary Embodiment

Figure 2:
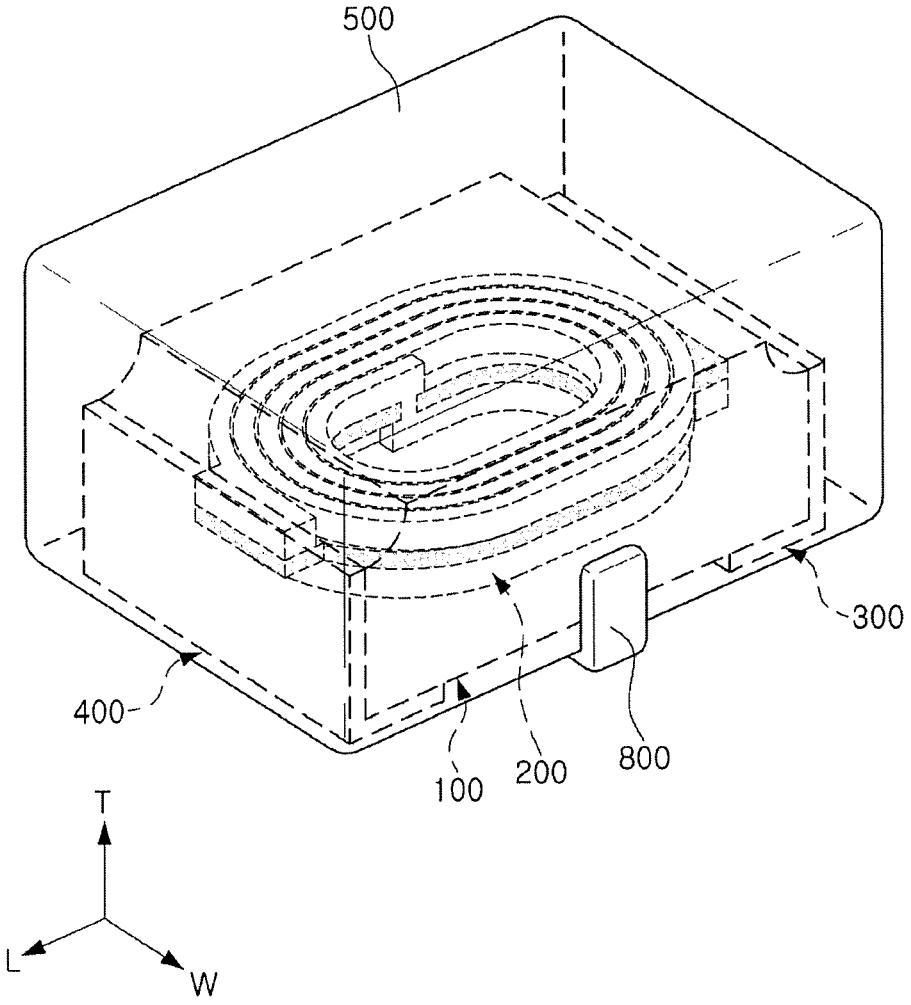
FIG. 2 is a view illustrating the configuration of FIG. 1 except for some configurations of FIG. 1.
Figure 3:
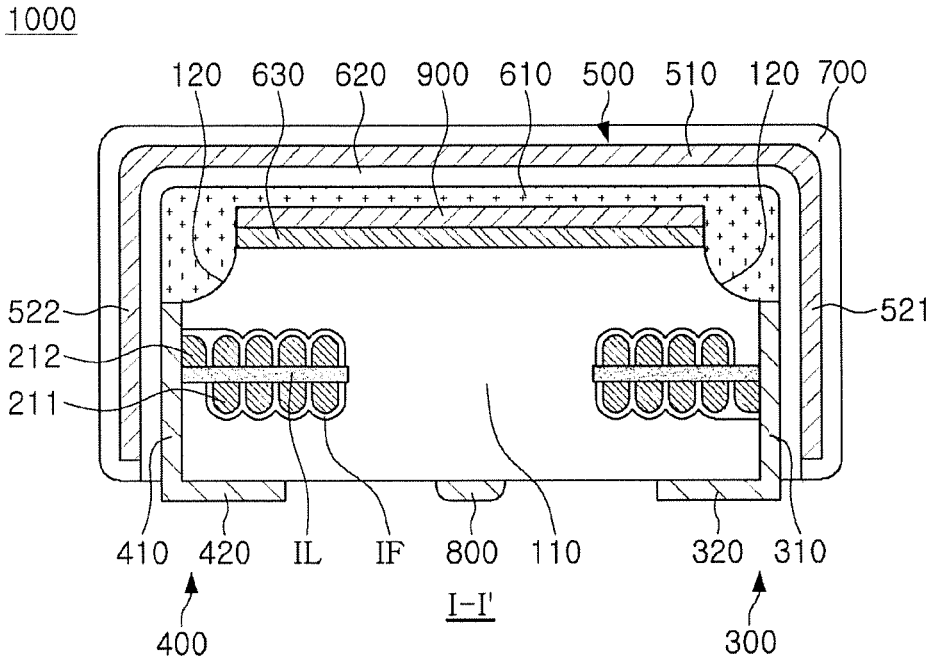
FIG. 3 is a view illustrating a cross section taken along a line I-I' of FIG. 1.
Figure 4:
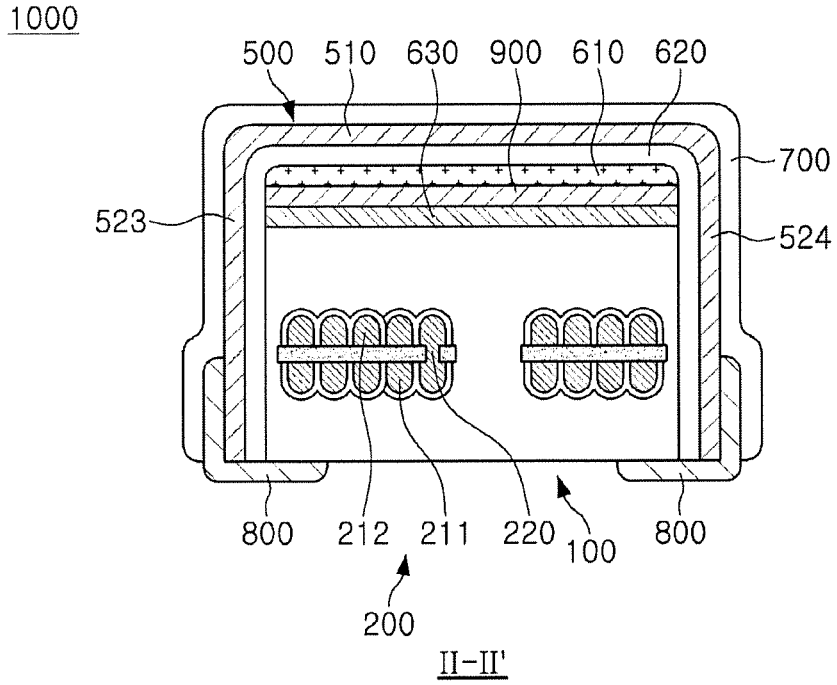
FIG. 4 is a view illustrating a cross section taken along a line II-II' of FIG. 1.

FIG. 1 is a perspective view schematically illustrating a coil component according to a first exemplary embodiment in the present disclosure. FIG. 2 is a view illustrating the configuration of FIG. 1 except for some configurations of FIG. 1. FIG. 3 is a view illustrating a cross section taken along a line I-I' of FIG. 1. FIG. 4 is a view illustrating a cross section taken along a line II-II' of FIG. 1. Meanwhile, for convenience and understanding of the description, FIG. 2 does not illustrate a cover layer.

Referring to FIGS. 1 through 4, a coil component 1000 according to a first exemplary embodiment in the present disclosure may include a body 100, a coil portion 200, external electrodes 300 and 400, a conductive shielding layer 500, insulating layers 610 and 620, a ground electrode 800, and a magnetic shielding layer 900, and may further include a cover layer 700, an intermediate insulating layer 630, an internal insulating layer IL, and an insulating film IF.

The body 100 may form an outer shape of the coil component 1000 according to the present exemplary embodiment and may have the coil portion 200 embedded therein.

The body 100 may be formed in a hexahedral shape as a whole.

Hereinafter, the present disclosure will be described on the assumption that the body 100 has illustratively the hexahedral shape. However, such a description does not exclude a coil component including a body formed in a shape other than the hexahedral shape from the scope of the present disclosure.

The body 100 may include a first surface and a second surface opposing each other in a length direction (L), a third surface and a fourth surface opposing each other in a width direction (W), and a fifth surface and a sixth surface opposing each other in a thickness direction (T). The first to fourth surfaces of the body 100 connecting the fifth surface and the sixth surface of the body 100 to each other correspond to wall surfaces of the body 100, respectively. The first surface and the second surface of the body 100 opposing each other of a plurality of wall surfaces of the body 100 may be represented as both end surfaces, and the third surface and the fourth surface of the body 100 opposing each of the plurality of wall surfaces may be represented as both side surfaces.

The body 100 may be illustratively formed so that the coil component 1000 according to the present exemplary embodiment in which the external electrodes 300 and 400, the insulating layers 610 and 620, the conductive shielding layer 500, and the cover layer 700 to be described below are formed has a length of 2.0 mm, a width of 1.2 mm, and a thickness of 0.65 mm, but is not limited thereto.

The body 100 may contain a magnetic material and a resin. Specifically, the body 100 may be formed by stacking one or more magnetic composite sheets in which the magnetic material is dispersed in the resin.

The magnetic material may be a ferrite or a metallic magnetic powder.

The ferrite may include at least one or more of a spinel type ferrite such as Mg—Zn based, Mn—Zn based, Mn—Mg based, Cu—Zn based, Mg—Mn—Sr based, Ni—Zn based, or the like, a hexagonal type ferrite such as Ba—Zn based, Ba—Mg based, Ba—Ni based, Ba—Co based, Ba—Ni—Co based, or the like, and garnet type ferrite such as Y-based or the like, and Li-based ferrite.

The metallic magnetic powder may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metallic magnetic powder may include at least one or more of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, Fe—Cr—Al based alloy powder, and the like.

The metallic magnetic powder may be amorphous or crystalline. For example, the metallic magnetic powder may be Fe—Si—B—Cr based amorphous alloy powder, but is not necessarily limited thereto.

Each of the ferrite and the metallic magnetic powder may have an average diameter of about 0.1 μm to 30 μm, but is not limited thereto.

The body 100 may include two or more kinds of magnetic materials dispersed in the resin. Here, a meaning that the magnetic materials are different kinds means that the magnetic materials dispersed in the resin are distinguished from each other by any one of an average diameter, a composition, a crystallinity and a shape.

The resin may include, but is not limited to, epoxy, polyimide, liquid crystal polymer, etc., alone or in combination.

The body 100 may include a core 110 penetrating through the coil portion 200 to be described below. The core 110 may be formed by filling a through-hole of the coil portion 200 with the magnetic composite sheet, but is not limited thereto.

An electrode bleeding prevention groove 120 may be formed in the fifth surface of the body 100. The electrode bleeding prevention groove 120 may prevent an electrical short between the external electrodes 300 and 400 in a case of forming the external electrodes 300 and 400 to be described below on the surface of the body 100. As an example, the electrode bleeding prevention groove 120 may reduce a probability of the electrical short between the external electrodes 300 and 400 by increasing paths on which the external electrodes 300 and 400 may be formed in a case of forming the external electrodes 300 and 400 by a plating process, a paste printing process, or the like.

The electrode bleeding prevention grooves 120 may be formed at a corner between the fifth surface of the body 100 and the first surface of the body 100, and a corner of the fifth surface of the body 100 and the second surface of the body 100, respectively. The electrode bleeding prevention groove 120 may be formed over the entirety of the corners described above in the width direction W of the body 100. However, the electrode bleeding prevention grooves 120 are not limited to the scope of the present disclosure, and there is no limitation on the formation position, shape and number of the electrode bleeding prevention grooves 120, as long as the electrode bleeding prevention grooves 120 perform the function of increasing the paths on which the external electrodes 300 and 400 are formed.

The coil portion 200 may be embedded in the body 100 to manifest the characteristics of the coil component. For example, in a case in which the coil component 1000 according to the present exemplary embodiment is utilized as a power inductor, the coil portion 200 may serve to stabilize power of the electronic device by storing an electric field as a magnetic field and maintaining an output voltage.

The coil portion 200 may include a first coil pattern 211, a second coil pattern 212, and a via 220.

The first coil pattern 211, an internal insulating layer IL to be described below, and the second coil pattern 212 may be sequentially stacked along the thickness direction T of the body 100.

Each of the first coil pattern 211 and the second coil pattern 212 may be formed in a shape of a flat spiral. The first coil pattern 211 may form at least one turn around the thickness direction (T) of the body 100 on one surface of the internal insulating layer IL (a lower surface of IL in FIG. 3).

The via 220 may penetrate through the internal insulating layer IL to electrically connect the first coil pattern 211 and the second coil pattern 212 to each other and may be in contact with the first coil pattern 211 and the second coil pattern 212, respectively. As a result, the coil portion 200 applied to the present exemplary embodiment may be formed as a single coil generating a magnetic field in the thickness direction (T) of the body 100.

At least one of the first coil pattern 211, the second coil pattern 212, and the via 220 may include one or more conductive layers.

As an example, in a case in which the second coil pattern 212 and the via 220 are formed by a plating method, the second coil pattern 212 and the via 220 may include a seed layer of an electroless plating layer and an electroplating layer. Here, the electroplating layer may have a single layer structure or a multilayer structure. The electroplating layer having the multilayer structure may also be formed in a conformal film structure in which the other electroplating layer covers any one electroplating layer, or may also be formed in a shape in which the other electroplating layer is stacked only on one surface of any one electroplating layer. The seed layer of the second coil pattern 212 and the seed layer of the via 220 may be integrally formed without forming a boundary therebetween, but are not limited thereto. The electroplating layer of the second coil pattern 212 and the electroplating layer of the via 220 may be integrally formed without forming a boundary therebetween, but are not limited thereto.

As another example, in a case in which the first coil pattern 211 and the second coil pattern 212 are separately formed and are then stacked together on the internal insulating layer IL to form the coil portion 200, the via 220 may include a high melting point metal layer and a low melting point metal layer having a melting point lower than the melting point of the high melting point metal layer. Here, the low melting point metal layer maybe formed of a solder including a lead (Pb) and/or tin (Sn). The low melting point metal layer is at least partially melted due to the pressure and temperature at the time of stacking together of the first coil pattern 211 and the second coil pattern 212, such that an inter metallic compound (IMC) layer may be formed between the low melting point metal layer and the first coil pattern 211, between the low melting point metal layer and the second coil pattern 212, or between the high melting point metal layer and the low melting point metal layer.

The first coil pattern 211 and the second coil pattern 212 may protrude, for example, on a lower surface and an upper surface of the internal insulating layer IL, respectively. As another example, the first coil pattern 211 is embedded in the lower surface of the internal insulating layer IL such that a lower surface of the first coil pattern 211 may be exposed to the lower surface of the internal insulating layer IL, and the second coil pattern 212 may protrude on the upper surface of the internal insulating layer IL. In this case, a concave portion may be formed in the lower surface of the first coil pattern 211. As a result, the lower surface of the internal insulating layer IL and the lower surface of the first coil pattern 211 may not be positioned on the same plane. As another example, the first coil pattern 211 is embedded in the lower surface of the internal insulating layer IL such that the lower surface of the first coil pattern 211 may be exposed to the lower surface of the internal insulating layer IL, and the second coil pattern 212 is embedded in the upper surface of the internal insulating layer IL such that an upper surface of the second coil pattern 212 may be exposed to the upper surface of the internal insulating layer IL.

End portions of the first coil pattern 211 and the second coil pattern 212, respectively, may be exposed to the first surface and the second surface of the body 100, which are both end surfaces of the body 100. The end portion of the first coil pattern 211 exposed to the first surface of the body 100 may be in contact with a first external electrode 300 to be described above, such that the first coil pattern 211 may be electrically connected to the first external electrode 300. The end portion of the second coil pattern 212 exposed to the second surface of the body 100 may be in contact with a second external electrode 400 to be described above, such that the second coil pattern 212 may be electrically connected to the second external electrode 400.

Each of the first coil pattern 211, the second coil pattern 212, and the via 220 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The internal insulating layer IL may be formed of an insulating material including a thermosetting insulating resin such as an epoxy resin, a thermoplastic insulating resin such as polyimide, or a photosensitive insulating resin, or may be formed of an insulating material having a reinforcement material such as a glass fiber or an inorganic filler impregnated in the insulating resin. As an example, the internal insulating layer IL may be formed of an insulating material such as prepreg, Ajinomoto Build-up Film (ABF), FR-4, Bismaleimide Triazine (BT) resin, photo imagable dielectric (PID), or the like.

As an inorganic filler, at least one selected from the group consisting of silica ($SiO_2$), alumina ($Al_2O_3$), silicon carbide (SiC), barium sulfate ($BaSO_4$), talc, clay, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$) may be used.

In a case in which the internal insulating layer IL is formed of the insulating material including the reinforcement material, the internal insulating layer IL may provide more excellent rigidity. In a case in which the internal insulating layer IL is formed of an insulating material that does not include the glass fiber, the internal insulating layer IL may be advantageous in thinning the total thickness of the coil portion 200. In a case in which the internal insulating layer IL is formed of an insulating material including the photosensitive insulating resin, the number of processes may be reduced, which is advantageous in reducing the production cost and is advantageous for fine hole machining.

The insulating film IF maybe formed along the surfaces of the first coil pattern 211, the internal insulating layer IL, and the second coil pattern 212. The insulating film IF, which protects and insulates the respective coil patterns 211 and 212, may include a known insulating material such as parylene. The insulating material included in the insulating film IF may be any material and is not particularly limited. The insulating film IF may be formed by vapor deposition or the like, but is not limited thereto, and may also be formed by stacking an insulating material such as an insulating film on both surfaces of the internal insulating layer IL on which the first and second coil patterns 211 and 212 are formed. However, the insulating film IF described above may also be omitted in the present exemplary embodiment depending on design requirements and the like.

Meanwhile, although not illustrated, at least one of the first coil pattern 211 and the second coil pattern 212 may be formed in plural. For example, the coil portion 200 may have a structure in which a plurality of first coil patterns 211 are formed and the other of the first coil patterns is stacked on the lower surface of one of the first coil patterns. In this case, an additional insulating layer may be disposed between the plurality of first coil patterns 211, and a connection via penetrating through the additional insulating layer may be formed in the additional insulating layer so as to connect the adjacent first coil patterns to each other.

The insulating layers 610 and 620 may surround the fifth surface of the body 100 and the first to fourth surfaces, which are the plurality of wall surfaces of the body 100. In the case of the present exemplary embodiment, since connection parts 310 and 410 of the external electrodes 300 and 400 to be described below are disposed on the first and second surfaces of the body 100, and a magnetic shielding layer 900 to be described below is disposed on the fifth surface of the body 100, the insulating layers 610 and 620 may surround the connection parts 310 and 410 of the external electrodes 300 and 400, and the magnetic shielding layer 900.

The insulating layers 610 and 620 may include a first insulating layer 610 and a second insulating layer 620. The first insulating layer 610 may be formed on the fifth surface of the body 100 so as to surround the magnetic shielding layer 900 and may be formed in at least a portion of the electrode bleeding prevention groove 120. The second insulating layer 620 may be disposed on the first to fifth surfaces of the body 100 on which the first insulating layer 610 is disposed to surround the first insulating layer 610, the connection parts 310 and 410 of the external electrodes 300 and 400, and the magnetic shielding layer 900.

The insulating layers 610 and 620 may be formed of a thermoplastic resin such as a polystyrene based, a vinyl acetate based, a polyester based, a polyethylene based, a polypropylene based, a polyamide based, a rubber based, and an acrylic based, a thermosetting resin such as a phenol based, an epoxy based, a urethane based, a melamine based, and an alkyd based, a photosensitive resin, parylene, SiOx, or SiNx.

The insulating layers 610 and 620 may be formed by stacking the insulating material such as the insulating film on the surfaces of the body 100 and may be formed by a thin film process such as chemical vapor deposition (CVD). As an example, the first insulating layer 610 may be formed by stacking an insulating material such as Ajinomoto Build-up Film (ABF) on the fifth surface of the body 100, and the second insulating layer 620 may be formed by vapor-depositing parylene on the first to fifth surfaces of the body 100, but the scope of the present disclosure is not limited to the above description.

The insulating layers 610 and 620 may be formed in a range of a thickness of 10 nm to 100 μm. In a case in which the thickness of the insulating layers 610 and 620 is less than 10 nm, characteristics of the coil component such as a Q factor may be reduced, and in a case in which the thickness of the insulating layers 610 and 620 exceeds 100 μm, the total length, width, and thickness of the coil component increase, which is disadvantageous for thinning.

The external electrodes 300 and 400 may be disposed between the first and second surfaces of the body 100, which are both end surfaces of the body, and the insulating layers 610 and 620, may extend to the sixth surface of the body 100, which is one surface of the body 100, and may be connected to the coil portion 200. The external electrodes 300 and 400 may include a first external electrode 300 connected to the first coil pattern 211 and a second external electrode 400 connected to the second coil pattern 212.

Specifically, the first external electrode 300 may include a first connection part 310 disposed on the first surface of the body 100 and connected to the end portion of the first coil pattern 211, and a first extension part 320 extending from the first connection part 310 to the sixth surface of the body 100. The second external electrode 400 may include a second connection part 410 disposed on the second surface of the body 100 and connected to the end portion of the second coil pattern 212, and a second extension part 420 extending from the second connection part 410 to the sixth surface of the body 100. The first extension part 310 and the second extension part 410 disposed on the sixth surface of the body 100 may be spaced apart from each other so that the first external electrode 300 and the second external electrode 400 are not in contact with each other.

The external electrodes 300 and 400 may electrically connect the coil component 1000 to the printed circuit board or the like when the coil component 1000 according to the present exemplary embodiment is mounted on the printed circuit board or the like. As an example, the coil component 1000 according to the present exemplary embodiment may be mounted after the sixth surface of the body 100 is disposed to face the printed circuit board. The coil component 1000 according to the present exemplary embodiment may be easily connected to the printed circuit board or the like by the extension parts 320 and 420 of the external electrodes 300 and 400 disposed on the sixth surface of the body 100.

The external electrodes 300 and 400 may include at least one of a conductive resin layer and an electroplating layer. The conductive resin layer may be formed by paste printing or the like, and may contain one or more conductive metals selected from the group consisting of copper (Cu), nickel (Ni), and silver (Ag), and a thermosetting resin. The electroplating layer may include one or more selected from the group consisting of nickel (Ni), copper (Cu), and tin (Sn).

The conductive shielding layer 500 may be disposed on the insulating layers 610 and 620. Therefore, the conductive shielding layer 500 may be disposed on the first to fifth surfaces of the body 100. Specifically, the conductive shielding layer 500 may include a cap portion 510 disposed on the fifth surface of the body 100, which is the other surface of he body 100, and sidewall portions 521, 522, 523, and 524 connected to the cap portion 510 and disposed on the first to fourth surfaces of the body, which are the plurality of wall surfaces of the body 100, respectively. That is, the conductive shielding layer 500 may be disposed all surfaces of the body 100 except for the sixth surface of the body 100, which is a mounting surface of the coil component 1000 according to the present exemplary embodiment.

The first to fourth sidewall portions 521, 522, 523, and 524 may be formed integrally with each other. The first to fourth sidewall portions 521, 522, 523, and 524 may be formed in the same process so that no boundary may be formed between them. As an example, the first to fourth sidewall portions 521, 522, 523, and 524 may be formed integrally by stacking a single shielding sheet including an insulating film and a metal shielding film on the first to fifth surfaces of the body 100. Here, the insulating film of the shielding sheet may correspond to the second insulating layer 620 described above. Meanwhile, in the above example, due to a physical processing of the shielding sheet, a cross section of a region where one sidewall portion and the other sidewall portion are connected may form a curved surface. As another example, in a case in which the first to fourth sidewall portions 521, 522, 523, and 524 are formed on the first to fourth surfaces of the body 100 by vapor deposition such as sputtering, the first to fourth sidewall portions 521, 522, 523, and 524 may be integrally formed.

The cap portion 510 and the sidewall portion 520 may be integrally formed. That is, the cap portion 510 and the sidewall portion 520 may be formed in the same process so that no boundary may be formed between them. As an example, the cap portion 510 and the sidewall portion 520 may be integrally formed by attaching the single shielding sheet including the insulating film and the metal shielding film onto the first to fifth surfaces of the body 100. Here, the insulating film of the shielding sheet may correspond to the second insulating layer 620 described above. As another example, the cap portion 510 and the sidewall portion 520 may be integrally formed by forming the conductive shielding layer 500 on the first to fifth surfaces of the body 100 on which the insulating layers 610 and 620 are formed by vapor deposition such as sputtering.

The cap portion 510 and the sidewall portions 521, 522, 523, and 524 may be connected to each other with a curved surface. As an example, in a case in which the shielding sheet is attached to the first to fifth surfaces of the body 100 after the shielding sheet is formed to correspond to the shape of the body, the cross-section of the region to which the cap portion 510 and the side wall portions 521, 522, 523, and 524 are connected to each other may be formed as the curved surface. As another example, in a case in which the conductive shielding layer 500 is formed on the first to fifth surfaces of the body 100 on which the insulating layers 610 and 620 are formed by vapor deposition such as sputtering, the cross-section of the region to which the cap portion 510 and the side wall portions 521, 522, 523, and 524 are connected to each other may be formed as the curved surface.

The conductive shielding layer 500 may include a conductor, and may be formed of, for example, a metal or an alloy including one or more selected from the group consisting of copper (Cu), aluminum (Al), iron (Fe), silicon (Si), boron (B), chromium (Cr), niobium (Nb), titanium (Ti), and nickel (Ni). The conductive shielding layer 500 may have a single layer structure or a multilayer structure.

The conductive shielding layer 500 may be formed in a range of a thickness of 10 nm to 100 μm. In a case in which the thickness of the conductive shielding layer 500 is less than 10 nm, a leakage magnetic flux shielding effect may be extremely low, and in a case in which the thickness of the conductive shield layer 500 exceeds 100 μm, the total length, width, and thickness of the coil component may increase, which is disadvantageous for thinning.

The magnetic shielding layer 900 may be disposed between the fifth surface of the body 100 and the insulating layers 610 and 620. Specifically, the magnetic shielding layer 900 may be disposed on the fifth surface of the body 100 and may be covered with the first insulating layer 610 disposed on the fifth surface of the body 100.

The magnetic shielding layer 900 may include a magnetic material. The magnetic material may be a ferrite or a metallic magnetic powder. The ferrite may include at least one or more of a spinel type ferrite such as Mg—Zn based, Mn—Zn based, Mn—Mg based, Cu—Zn based, Mg—Mn—Sr based, Ni—Zn based, or the like, a hexagonal type ferrite such as Ba—Zn based, Ba—Mg based, Ba—Ni based, Ba—Co based, Ba—Ni—Co based, or the like, and garnet type ferrite such as Y-based or the like, and Li-based ferrite. The metallic magnetic powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the metallic magnetic powder may include at least one or more of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, Fe—Cr—Al based alloy powder, and the like.

The magnetic shielding layer 900 may include a resin. Specifically, the magnetic shielding layer 900 may be one in which the above-mentioned magnetic material is dispersed in the resin in the form of powder. The resin may include, but is not limited to, epoxy, polyimide, liquid crystal polymer, etc., alone or in combination.

The magnetic shielding layer 900 may be formed by stacking a shielding sheet including a magnetic shielding film on the fifth surface of the body 100, but is not limited thereto.

The magnetic shielding layer 900 may be formed in a range of a thickness of 10 nm to 100 μm. In a case in which the thickness of the magnetic shielding layer 900 is less than 10 nm, a leakage magnetic flux shielding effect may be extremely low, and in a case in which the thickness of the magnetic shielding layer 900 exceeds 100 μm, the total length, width, and thickness of the coil component may increase, which is disadvantageous for thinning.

The intermediate insulating layer 630 may be disposed between the fifth surface of the body 100 and the magnetic shielding layer 900. The intermediate insulating layer 630 may be formed by stacking the insulating material such as the insulating film on the fifth surface of the body 100 and may be formed by a thin film process such as chemical vapor deposition (CVD). As an example, the intermediate insulating layer 630 may be formed by stacking an insulating material such as an Ajinomoto Build-up Film (ABF) or a dry film (DF) on the fifth surface of the body 100.

The intermediate insulating layer 630 and the magnetic shielding layer 900 may be formed by stacking a shielding sheet including an insulating film and a magnetic shielding film on the fifth surface of the body 100, but are not limited thereto.

The ground electrode 800 may be connected to the conductive shielding layer 500 on the first to fourth surfaces of the body 100, which are the wall surfaces of the body 100, and may extend to the sixth surface of the body 100. According to the present exemplary embodiment, the ground electrode 800 may be formed on the third and fourth sidewall portions 523 and 524 disposed on the third and fourth surfaces of the body 100, respectively, and may be connected to the conductive shielding layer 500.

Since the ground electrode 800 is disposed to extend to the sixth surface of the body 100, the ground electrode 800 may be easily connected to a ground pad of the printed circuit board or the like in mounting the coil component 1000 according to the present exemplary embodiment on the printed circuit board or the like.

The ground electrode 800 may include a conductive resin layer. The conductive resin layer may be formed by applying a conductive paste by a printing or the like, and may contain one or more conductive metals selected from the group consisting of copper (Cu), nickel (Ni), and silver (Ag), and a thermosetting resin. However, the ground electrode 800 may also be formed by a method other than the paste printing method. As an example, the ground electrode 800 may be formed by performing selective electrolytic plating on the surfaces of the body 100 or by a method such as selective vapor deposition.

The cover layer 700 may be disposed on the conductive shielding layer 500 to cover a portion of the ground electrode 800 disposed on the wall surfaces of the body 100 and the conductive shielding layer 500 and may be in contact with the second insulating layer 620, Specifically, the cover layer 700 may be disposed on the first to fifth surfaces of the body 100, and may cover the other end of each of the first to fourth sidewall portions 521, 522, 523, and 524 to be in contact with the second insulating layer 620. That is, the cover layer 700 may bury the conductive shielding layer 500 together with the second insulating layer 620 therein. The cover layer 700 may prevent electrical connections between the sidewall portions 521, 522, 523, and 524 and the extension portions 320 and 420 by covering the other end of each of the first to fourth sidewall portions 521, 522, 523, and 524. Further, the cover layer 700 may prevent the conductive shielding layer 500 from being electrically connected to other external electronic components.

The cover layer 700 may be formed of at least one of a thermoplastic resin such as a polystyrene based, a vinyl acetate based, a polyester based, a polyethylene based, a polypropylene based, a polyamide based, a rubber based, and an acrylic based, a thermosetting resin such as a phenol based, an epoxy based, a urethane based, a melamine based, and an alkyd based, and a photosensitive insulating resin. In addition, the cover layer may be formed of parylene.

The cover layer 700 may be formed by stacking, for example, an insulating material such as an insulating film. As another example, the cover layer 700 may be formed by forming an insulating material by vapor deposition such as chemical vapor deposition (CVD).

The cover layer 700 may be formed in a range of a thickness of 10 nm to 100 μm. In a case in which the thickness of the cover layer 700 is less than 10 nm, an electrical short may occur with the external electrodes 300 and 400 because insulation characteristic is weak, and in a case in which the thickness of the cover layer 700 exceeds 100 μm, the total length, width, and thickness of the coil component may increase, which is disadvantageous for thinning.

The sum of the thicknesses of the insulating layers 610 and 620, the conductive shielding layer 500, the magnetic shielding layer 900, and the cover layer 700 may be more than 30 nm but not more than 100 μm. In a case in which the sum of the thicknesses of the insulating layers 610 and 620, the conductive shielding layer 500, the magnetic shielding layer 900, and the cover layer 700 is less than 30 nm, a problem of an electrical short, a problem of reduction in characteristics of the coil component such as the Q factor, or the like may occur, and in a case in which sum of the thicknesses of the insulating layers 610 and 620, the conductive shielding layer 500, the magnetic shielding layer 900, and the cover layer 700 exceeds 100 μm, the total length, width, and thickness of the coil component may increase, which is disadvantageous for thinning.

Meanwhile, although not illustrated in FIGS. 1 through 4, a separate additional insulating layer that is distinct from the insulating layers 610 and 620 may be formed on a region of the first to sixth surface of the body 100 where the external electrodes 300 and 400 are not formed. The separate additional insulating layer that is distinct from the insulating layers 610 and 620 may be formed on a region of the third to fifth and sixth surfaces of the body 100 where the extension portions 320 and 420 are not formed. In this case, the ground electrode 800 described above may be formed on an additional insulating layer formed on the sixth surface of the body 100. In addition, in this case, the second insulating layer 620 may be in contact with the additional insulating layer on the third and fourth surfaces of the body 100. The additional insulating layer may serve as a plating resist in forming the external electrodes 300 and 400 by plating, but is not limited thereto.

In addition, FIGS. 1 though 4 illustrate that there are two ground electrodes 800, but this is only an example, so that the ground electrode 800 may be formed in a single number or in a plural not two.

Since the insulating layers 610 and 620 and the cover layer 700 according to the present disclosure are disposed on the coil component itself, the insulating layers 610 and 620 and the cover layer 700 may be distinguished from a molding material that molds the coil component and the printed circuit board in an operation of mounting the coil component on the printed circuit board. As an example, the insulating layers 610 and 620 and the cover layer 700 according to the present disclosure may define a forming region without the printed circuit board unlike the molding material. Therefore, the insulating layers 610 and 620 according to the present disclosure may be not in contact with the printed circuit board and may not be supported or fixed by the printed circuit board unlike the molding material. In addition, unlike the molding material surrounding the connection member such as the solder ball connecting the coil portion and the printed circuit board to each other, the insulating layers 610 and 620 and the cover layer 700 according to the present disclosure may not be formed so as to surround the connection member. In addition, since the insulating layers 610 and 620 according to the present disclosure are not the molding materials formed by heating an epoxy molding compound (EMC) or the like to allow the EMC to flow onto the printed circuit board and curing, it is not necessary to take into consideration generation of voids during formation of the molding material and occurrence of warpage of the printed circuit board due to a difference in a coefficient of thermal expansion between the molding material and the printed circuit board.

In addition, since the conductive shielding layer 500 and the magnetic shielding layer 900 according to the present disclosure are disposed on the coil component itself, the conductive shield layer 500 and the magnetic shield layer 900 may be distinguished from a shield can which is coupled to the printed circuit board for EMI shielding after the coil component is mounted on the printed circuit board. As an example, unlike the shield can, the conductive shielding layer 500 and the magnetic shielding layer 900 according to the present disclosure may not consider a physical connection with the printed circuit board.

The coil component 1000 according to the present exemplary embodiment may more effectively block the leakage magnetic flux generated in the coil component by forming the conductive shielding layer 500 and the magnetic shielding layer 900 on the coil component itself. That is, with the thinning and high performance of electronic devices, the total number of electronic components included in electronic devices and the distance between adjacent electronic components decrease. Accordingly, by shielding each coil component by itself, the leakage magnetic fluxes generated in the coil components may be more efficiently blocked, which is more advantageous for thinning and high performance of the electronic devices. Further, since an amount of an effective magnetic material in a shielding region increases as compared with the case of using the shield can, the characteristics of the coil component may be improved.

In addition, the coil component 1000 according to the present exemplary embodiment may have both an absorbing shielding effect and a reflective shielding effect. That is, the magnetic shielding layer 900 may absorb and shield the leakage magnetic flux in a low frequency band of 1 MHz or less, and the conductive shielding layer 500 may reflect and shield the leakage magnetic flux in a high frequency band exceeding 1 MHz. Therefore, the leakage magnetic flux may be efficiently shielded in a relatively wide frequency band.

Second Exemplary Embodiment

Figure 5:
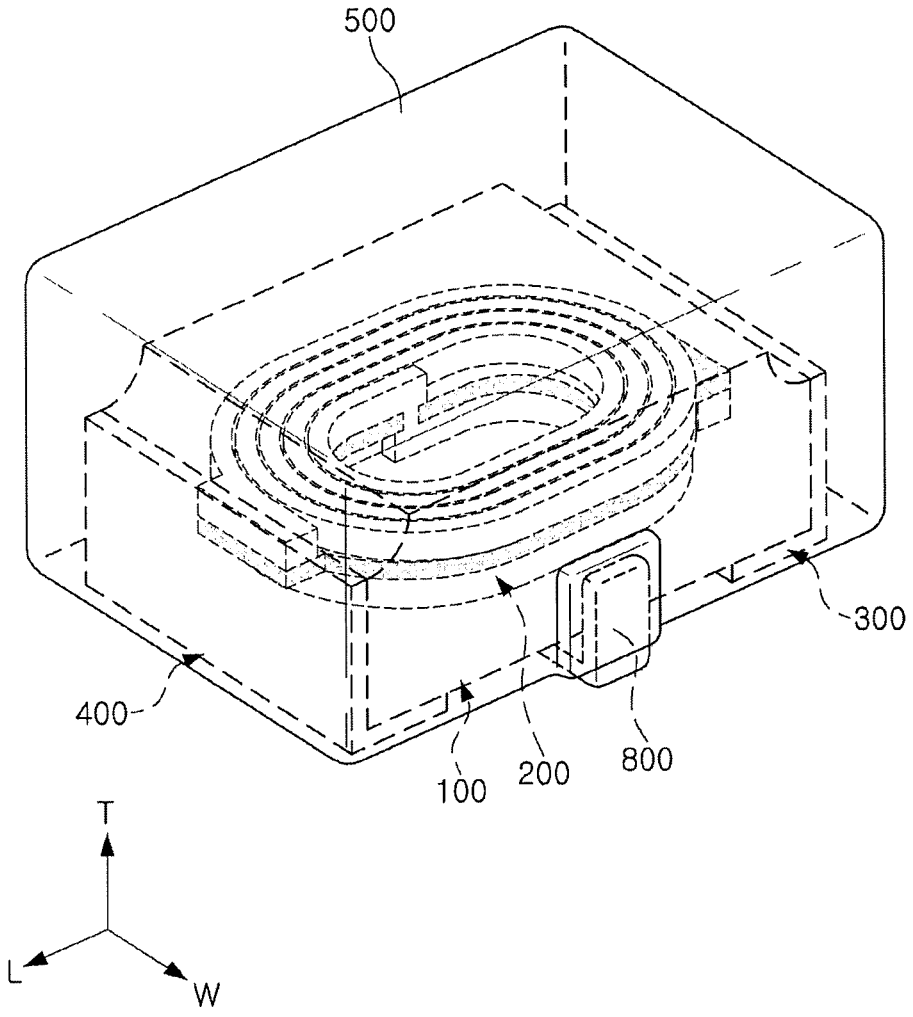
FIG. 5 is a view schematically illustrating a coil component according to a second exemplary embodiment in the present disclosure.
Figure 6:
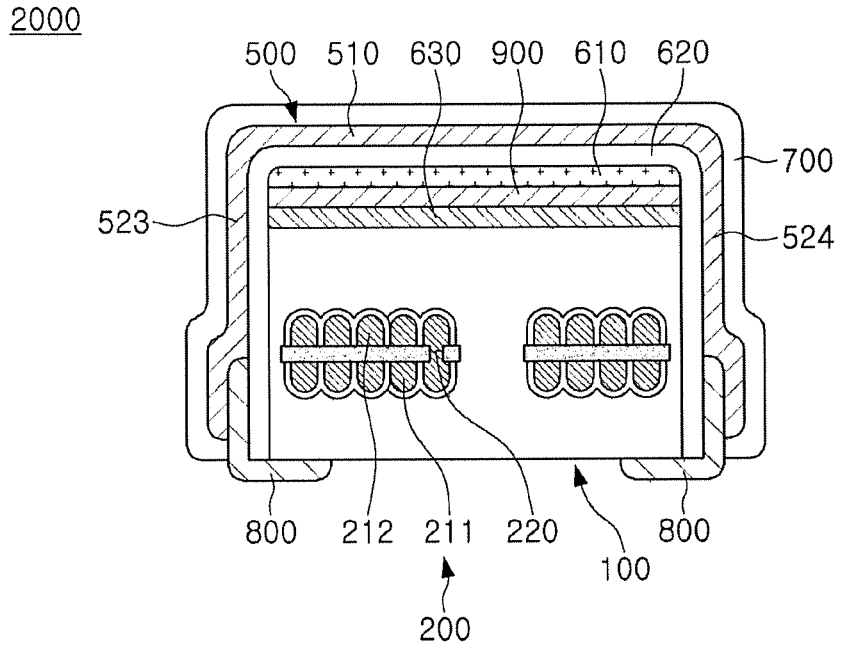
FIG. 6 is a view illustrating a cross section of the coil component according to the second exemplary embodiment in the present disclosure and corresponding the cross section taken along the line II-II' of FIG. 1.

FIG. 5 is a view schematically illustrating a coil component according to a second exemplary embodiment in the present disclosure. FIG. 6 is a view illustrating a cross section of the coil component according to the second exemplary embodiment in the present disclosure and is a view corresponding the cross section taken along a line II-II' of FIG. 1. Meanwhile, the cover layer is removed from FIG. 5 for convenience of description and understanding.

Referring to FIGS. 1 through 6, a coil component 2000 according to the present exemplary embodiment is different from the coil component 1000 according to the first exemplary embodiment in the present disclosure in a coupling relationship between the ground electrode 800 and the conductive shielding layer 500. Therefore, in describing the present exemplary embodiment, only the coupling relationship between the ground electrode 800 and the conductive shielding layer 500 which is different from the first exemplary embodiment of the present disclosure will be described. The description of the first exemplary embodiment in the present disclosure may be applied to the remaining configuration of the present exemplary embodiment as it is.

Referring to FIGS. 5 and 6, the ground electrode 800 may be disposed between the second insulating layer 620 and the conductive shielding layer 500 and extend to the sixth surface of the body 100. Specifically, the ground electrode 800 may be disposed between the third and fourth sidewall portions 523 and 524 and the second insulating layer 620. That is, the ground electrode 800 applied to the present exemplary embodiment may be formed on the second insulating layer 620 before forming the conductive shielding layer 500.

Third Exemplary Embodiment

Figure 7:
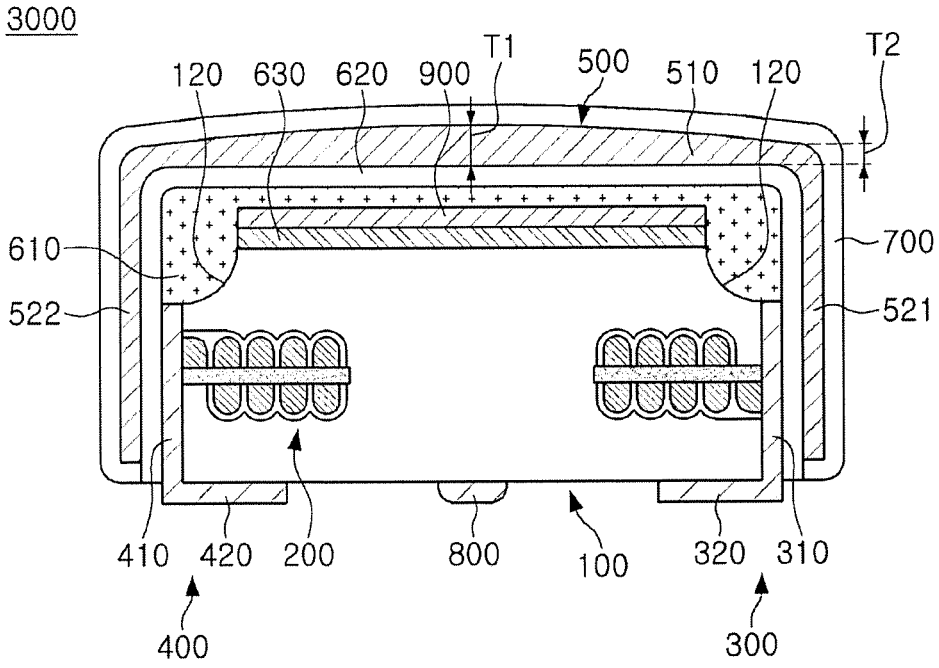
FIG. 7 is a view illustrating a cross section of a coil component according to a third exemplary embodiment in the present disclosure and corresponding the cross section taken along the line I-I' of FIG. 1.

FIG. 7 is a view illustrating a cross section of a coil component according to a third exemplary embodiment in the present disclosure and corresponding the cross section taken along the line I-I' of FIG. 1.

Referring to FIGS. 1 through 7, a coil component 3000 according to the present exemplary embodiment is different from the coil components 1000 and 2000 according to the first and second exemplary embodiments in the present disclosure in the cap portion 510. Therefore, in describing the present exemplary embodiment, only the cap portion 510 which is different from the first and second exemplary embodiments in the present disclosure will be described. The description of the first and second exemplary embodiments in the present disclosure may be applied to the remaining configuration of the present exemplary embodiment as it is.

Referring to FIG. 7, the cap portion 510 may be formed such that a thickness T1 of a central portion thereof is thicker than a thickness T2 of an outer portion thereof. This will be described in detail.

Each of the coil patterns 211 and 212 constituting the coil portion 200 according to the present exemplary embodiment may form a plurality of turns from the center of the internal insulating layer IL to the outer portion of the internal insulating layer IL on both surfaces of the internal insulating layer IL, and the coil patterns 211 and 212 may be stacked in the thickness direction T of the body 100 and connected to each other by a via 220. As a result, the coil component 3000 according to the present exemplary embodiment has the highest magnetic flux density at the central portion of a plane in a length direction L-width direction W of the body 100 perpendicular to the thickness direction T of the body 100. Therefore, in the present exemplary embodiment, in forming the cap portion 510 disposed on the fifth surface of the body 100 which is substantially in parallel to the plane in the length direction L-width direction W of the body 100, the thickness T1 of the central portion of the cap portion 510 may be formed to be thicker than the thickness T2 of the outer portion T2 thereof in consideration of a magnetic density distribution in the plane in the length direction L-width direction W of the body 100.

By doing so, the coil component 3000 according to the present exemplary embodiment may more efficiently reduce the leakage magnetic flux by forming the cap portion 510 to have a different thickness corresponding to the magnetic flux density distribution.

Fourth Exemplary Embodiment

Figure 8:
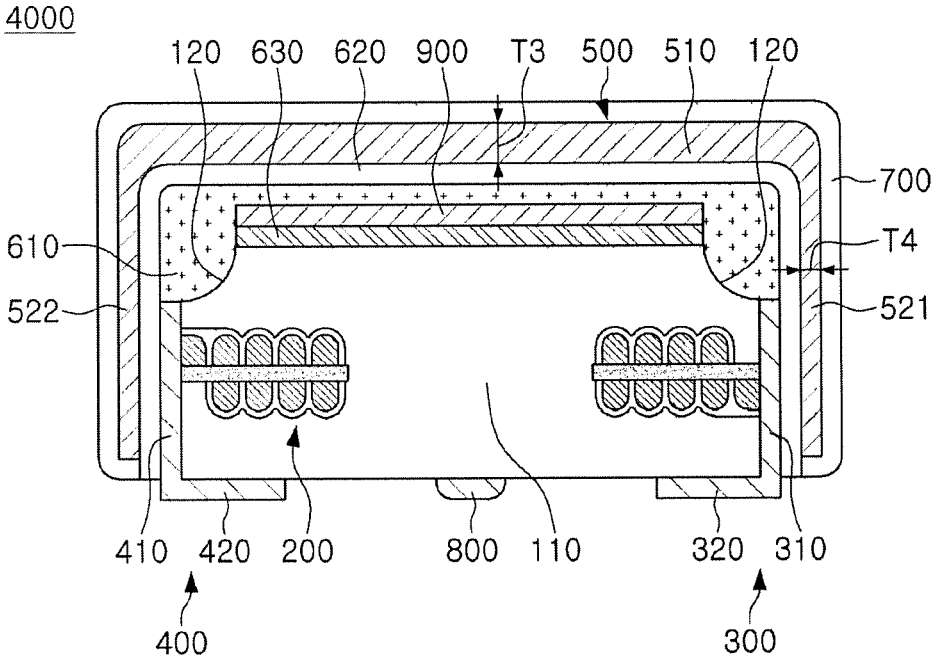
FIG. 8 is a view illustrating a cross section of a coil component according to a fourth exemplary embodiment in the present disclosure and corresponding the cross section taken along the line I-I' of FIG. 1.

FIG. 8 is a view illustrating a cross section of a coil component according to a fourth exemplary embodiment in the present disclosure and corresponding the cross section taken along the line I-I' of FIG. 1.

Referring to FIGS. 1 through 8, a coil component 4000 according to the present exemplary embodiment is different from the coil components 1000, 2000, and 3000 according to the first to third exemplary embodiments in the present disclosure in the cap portion 510 and the sidewall portions 521, 522, 523, and 524. Therefore, in describing the present exemplary embodiment, only the cap portion 510 and the sidewall portions 521, 522, 523, and 524 which are different from the first to third exemplary embodiments in the present disclosure will be described. The description of the first to third exemplary embodiments in the present disclosure may be applied to the remaining configuration of the present exemplary embodiment as it is.

Referring to FIG. 8, a thickness T3 of the cap portion 510 maybe thicker than a thickness T4 of the sidewall portions 521, 522, 523, and 524.

As described above, the coil portion 200 may generate the magnetic field in the thickness direction of the body 100. As a result, a magnetic flux leaked in the thickness direction T of the body 100 may be greater than that leaked in other directions. Therefore, the leakage magnetic flux may be more efficiently reduced by forming the thickness of the cap portion 510 disposed on the fifth surface of the body 100 perpendicular to the thickness direction T of the body 100 to be thicker than the thickness of the sidewall portions 521, 522, 523, and 524 disposed on the wall surfaces of the body 100.

As an example, the thickness of the cap portion 510 maybe formed to be thicker than the thickness of the sidewall portions 521, 522, 523, and 524 by forming a temporary shielding layer on the first to fifth surfaces of the body 100 with the shielding sheet including the insulating film and the metal shielding film and further forming the shielding material only on the fifth surface of the body 100. As another example, the thickness of the cap portion 510 may be formed to be thicker than the thickness of the sidewall portions 521, 522, 523, and 524 by disposing the body 100 so that the fifth surface of the body 100 faces a target and then performing sputtering for forming the shielding layer 500. However, the scope of the present disclosure is not limited to the examples described above.

By doing so, the coil component 4000 according to the present exemplary embodiment may efficiently reduce the leakage magnetic flux in consideration of a direction of the magnetic field formed by the coil portion 200.

Meanwhile, although the external electrodes 300 and 400 according to the present disclosure are described as being L-shaped electrodes including the connection portions 310 and 410 and the extension portions 320 and 420 in the exemplary embodiments in the present disclosure described above, this is merely for convenience of explanation and the external electrodes 300 and 400 may be modified in various forms. As an example, the external electrodes 300 and 400 are not formed on the first and second surfaces of the body 100, but may be formed only on the sixth surface of the body 100 and connected to the coil portion 200 through a via electrode or the like. An another example, the external electrodes 300 and 400 maybe C-shaped electrodes including the connection portions formed on the first and second surfaces of the body 100, respectively, the extension portion extending from the connection portions and disposed on the sixth surface of the body 100, and a band portion extending from the connection portions and disposed on the fifth surface of the body 100. An another example, the external electrodes 300 and 400 maybe five surface electrodes including the connection portions formed on the first and second surfaces of the body 100, respectively, the extension portion extending from the connection portions and disposed on the sixth surface of the body 100, and band portions extending from the connection portions and disposed on the third to fifth surfaces of the body 100.

In addition, in the exemplary embodiments in the present disclosure, although the structure of the coil portion is described as being a so-called thin film coil which forms the coil patterns by plating or sputtering, the scope of the present disclosure also includes a stacked type coil and a vertically arranged type coil. The stacked type coil means a coil that after the conductive paste is applied to each magnetic sheet, a plurality of magnetic sheets are stacked and then hardened or sintered. The vertically arranged type coil means a coil that the coil portion forms a turn around an axis parallel to the lower surface of the coil component, which is the mounting surface.

As set forth above, according to the exemplary embodiment in the present disclosure, the leakage magnetic flux of the coil component may be reduced.

In addition, the component characteristics may be substantially maintained while reducing the leakage magnetic flux of the coil component.

While exemplary embodiments have been shown and described above, it will be apparent to those skilled in the art that modifications and variations could be made without departing from the scope of the present invention as defined by the appended claims.

What is claimed is:

1. A coil component comprising:

a body having a first surface and a second surface opposing each other in one direction and a plurality of wall surfaces connecting the first surface and the second surface to each other;

a coil portion embedded in the body and having end portions exposed to end surfaces of the body opposing each other among the plurality of wall surfaces of the body;

an electrode bleeding prevention groove formed in the second surface of the body;

an insulating layer surrounding the second surface of the body and the plurality of wall surfaces of the body;

external electrodes disposed between the end surfaces of the body and the insulating layer, extending to the first surface of the body, and electrically connected to the coil portion;

a magnetic shielding layer disposed between the second surface of the body and the insulating layer;

a conductive shielding layer disposed on the insulating layer; and a ground electrode electrically connected to the conductive shielding layer on at least one of the plurality of wall surfaces of the body, extending to the first surface of the body, and disposed to be spaced apart from the external electrodes.

2. The coil component of claim 1, wherein the ground electrode includes a conductive resin layer.

3. The coil component of claim 1, wherein the ground electrode is disposed on the conductive shielding layer and extends to the first surface of the body.

4. The coil component of claim 1, wherein the ground electrode is disposed between the insulating layer and the conductive shielding layer and extends to the first surface of the body.

5. The coil component of claim 1, wherein the electrode bleeding prevention groove is formed in each corner between the second surface of the body and the end surfaces of the body.

6. The coil component of claim 1, further comprising an intermediate insulating layer disposed between the second surface of the body and the magnetic shielding layer.

7. The coil component of claim 1, wherein the conductive shielding layer includes a cap portion disposed on the second surface of the body, and sidewall portions disposed on the plurality of wall surfaces of the body, respectively, and a thickness of the cap portion at a central portion of the second surface of the body is thicker than a thickness of the cap portion at an outer portion of the second surface of the body.

8. The coil component of claim 1, wherein the conductive shielding layer includes a cap portion disposed on the second surface of the body, and sidewall portions disposed on the plurality of wall surfaces of the body, respectively, and a thickness of the cap portion is thicker than thicknesses of the sidewall portions.

9. The coil component of claim 1, further comprising a cover layer covering the conductive shielding layer.

10. A coil component comprising:

a body having a first surface and a second surface opposing each other along one direction, and a plurality of wall surfaces connecting the first surface and the second surface to each other;

a coil portion including a coil pattern embedded in the body and including at least one turn in one direction;

first and second external electrodes disposed on end surfaces of the body opposing each other among the plurality of wall surfaces of the body, extending to the first surface of the body, each electrically connected to the coil portion, and each including a plating layer;

an electrode bleeding prevention groove formed in each corner between the second surface of the body and the end surfaces of the body;

a first insulating layer and a magnetic shielding layer sequentially stacked on the second surface of the body;

a conductive shielding layer surrounding the second surface of the body and the plurality of wall surfaces of the body;

a second insulating layer disposed between the conductive shielding layer and the first and second external electrodes, between the conductive shielding layer and the magnetic shielding layer, and between the conductive shielding layer and surfaces of the body; and a ground electrode disposed on the conductive shielding layer and extending onto the first surface of the body.

11. The coil component of claim 10, wherein the ground electrode includes a conductive resin layer.

12. The coil component of claim 10, wherein the conductive shielding layer includes a cap portion disposed on the second surface of the body, and sidewall portions disposed on the plurality of wall surfaces of the body, respectively, and a thickness of the cap portion at a central portion of the second surface of the body is thicker than a thickness of the cap portion at an outer portion of the second surface of the body.

13. The coil component of claim 10, wherein the conductive shielding layer includes a cap portion disposed on the second surface of the body, and sidewall portions disposed on the plurality of wall surfaces of the body, respectively, and a thickness of the cap portion is thicker than thicknesses of the sidewall portions.

14. The coil component of claim 10, further comprising a cover layer covering the conductive shielding layer.

15. A coil component comprising:

a body having a first surface and a second surface opposing each other along one direction, and a plurality of wall surfaces connecting the first surface and the second surface to each other;

a coil portion including a coil pattern embedded in the body and including at least one turn in one direction;

first and second external electrodes disposed on end surfaces of the body opposing each other among the plurality of wall surfaces of the body, extending to the first surface of the body, each electrically connected to the coil portion, and each including a plating layer;

an electrode bleeding prevention groove formed in each corner between the second surface of the body and the end surfaces of the body;

a first insulating layer and a magnetic shielding layer sequentially stacked on the second surface of the body;

a conductive shielding layer surrounding the second surface of the body and the plurality of wall surfaces of the body;

a second insulating layer disposed between the conductive shielding layer and the first and second external electrodes, between the conductive shielding layer and the magnetic shielding layer, and between the conductive shielding layer and surfaces of the body; and a ground electrode disposed between the second insulating layer and the conductive shielding layer and extending onto the first surface of the body.

16. The coil component of claim 15, wherein the ground electrode includes a conductive resin layer.

17. The coil component of claim 15, wherein the conductive shielding layer includes a cap portion disposed on the second surface of the body, and sidewall portions disposed on the plurality of wall surfaces of the body, respectively, and a thickness of the cap portion at a central portion of the second surface of the body is thicker than a thickness of the cap portion at an outer portion of the second surface of the body.

18. The coil component of claim 15, wherein the conductive shielding layer includes a cap portion disposed on the second surface of the body, and sidewall portions disposed on the plurality of wall surfaces of the body, respectively, and a thickness of the cap portion is thicker than thicknesses of the sidewall portions.

19. The coil component of claim 15, further comprising a cover layer covering the conductive shielding layer.

* * * * *